US006273695B1

(12) United States Patent
Arbogast et al.

(10) Patent No.: US 6,273,695 B1
(45) Date of Patent: Aug. 14, 2001

(54) SICKLELESS INTERNAL GEAR WHEEL PUMP WITH SEALING ELEMENTS INSERTED INTO THE TOOTH TIPS

(75) Inventors: Franz Arbogast; Peter Peiz, both of Heidenheim (DE)

(73) Assignee: Voith Turbo GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/523,802

(22) Filed: Mar. 13, 2000

(30) Foreign Application Priority Data

Mar. 26, 1999 (DE) ..... 199 13 752
Dec. 11, 1999 (EP) ..... 99124717

(51) Int. Cl.[7] ..... F03C 2/00
(52) U.S. Cl. ..... 418/168; 418/112; 418/113
(58) Field of Search ..... 418/168, 112, 418/113

(56) References Cited

U.S. PATENT DOCUMENTS

| | | | | |
|---|---|---|---|---|
| 2,790,394 | * | 4/1957 | Mori | 418/113 |
| 2,866,417 | * | 12/1958 | Nubling | 418/114 |
| 3,306,226 | * | 2/1967 | Walter | 418/171 |
| 3,429,269 | * | 2/1969 | Walter | 418/124 |
| 3,799,709 | * | 3/1974 | Reitz et al. | 418/91 |
| 3,887,311 | * | 6/1975 | Louzecky | 418/113 |
| 3,947,161 | * | 3/1976 | McLain | 418/113 |
| 4,028,023 | * | 6/1977 | Labus | 418/168 |
| 4,228,932 | * | 10/1980 | Aonuma et al. | 418/124 |
| 4,801,255 | | 1/1989 | Wankel . | |
| 5,135,371 | * | 8/1992 | Arbogast et al. | 418/124 |
| 5,399,079 | * | 3/1995 | Peiz et al. | 418/168 |
| 5,451,150 | * | 9/1995 | Arbogast et al. | 418/116 |
| 5,540,573 | * | 7/1996 | Arbogast et al. | 418/124 |
| 5,582,514 | * | 12/1996 | Arbogast et al. | 418/116 |
| 6,095,782 | * | 8/2000 | Arbogast et al. | 418/124 |

FOREIGN PATENT DOCUMENTS

| | | | | |
|---|---|---|---|---|
| 1075124 | * | 2/1960 | (DE) | 418/113 |
| 14 50 328 | | 2/1969 | (DE) . | |
| 41 04 397 | | 9/1991 | (DE) . | |
| 40 11 952 | | 10/1991 | (DE) . | |
| 1373473 | | 8/1964 | (FR) . | |
| 1436094 | * | 5/1994 | (GB) | 418/113 |

* cited by examiner

*Primary Examiner*—Thomas Denion
*Assistant Examiner*—Theresa Trieu
(74) *Attorney, Agent, or Firm*—Baker & Daniels

(57) ABSTRACT

A sickleless gear wheel pump includes an internally geared hollow wheel including a plurality of tooth tips. A pinion includes a plurality of tooth tips and meshes with the hollow wheel. The hollow wheel and pinion are rotatably disposed in a housing. The housing has a suction connection and a pressure connection. The hollow wheel has openings for a medium to be pumped therethrough. Each tooth tip of the plurality of tooth tips of the hollow wheel has a profile groove in which there is present a sealing element that is radially moveable during rotation of the hollow wheel and pinion and which is in sliding seal-off engagement with a respective tooth tip of the plurality of tooth tips of the pinion. Each sealing element is metallic.

2 Claims, 2 Drawing Sheets

SICKLELESS INTERNAL GEAR WHEEL PUMP WITH SEALING ELEMENTS INSERTED INTO THE TOOTH TIPS

BACKGROUND OF THE INVENTION

The present invention relates to a sickleless internal gear wheel pump for the generating of high pressure according to the generic term of patent claim 1.

A pump of this category is known from DE 41 04 397 Al.

Internal gear wheel pumps have in general an internally geared hollow wheel with which and externally geared pinion with lower number of teeth meshes, i.e. stands in engagement in driving. Each tooth tip of the hollow wheel has a profile groove. Into this groove a sealing element is inserted. In turning of the pinion this sealing element comes into sliding contact with its tooth tips. In the process there is briefly established a sealing-off, which blocks off the suction space against the pressure space. For the achieving of a certain contact pressure the radial outer ends of the sealing elements are acted upon with springs.

The sealing elements consist, as a rule, of plastic. There it was hitherto assumed that a certain elasticity is necessary in respect to the sealing-off.

In practical operation it has proved that, especially at relatively high operating pressures, there occur manifestations that were hitherto inexplicable. To these there belongs above all a decline of the efficiency of the pump. But also pressure pulsations have set in, which are extremely undesired.

Underlying the invention is the problem of constructing an internal gear wheel pump in such manner that neither a decline of the efficiency nor pressure pulsations manifest themselves.

SUMMARY OF THE INVENTION

The apices of the tooth tips of the pinion lie on different radii. This is conditioned by manufacturing tolerances. This means, for example, that the apex point of the one tooth tip lies on a greater radius than the apex point of the tooth tip of an adjoining tooth. For the sealing elements this means that also their sealing surfaces in the turning of the pinion lie from tooth to tooth on different radii. In a certain sense the sealing elements hereby carry out a dancing movement in radial direction. This leads to a relative movement of the individual sealing elements on the inner surface of the profile groove which is worked into the tooth tip of the hollow wheel.

A further circumstance is involved here: As stated above, the individual sealing element presents a blockade between the suction space and the pressure space. This means that on the sealing element a pressure differential acts, with pressure direction from the suction space to the pressure space. This means further, that the side surface of the sealing element facing the suction space is pressed against the corresponding inside surface of the profile groove. The micro-movement in radial direction mentioned leads, in respect to the pressure differential mentioned, to a grinding process. This results in a wear on the surfaces involved. The sealing is acted on in an extremely undesired manner on the sealing element's one surface. The wearing-down can be so severe that it leads to a tilting of the sealing elements and therewith to disturbances of the tooth engagement. For this reason it was also not possible to ascertain it as a cause for the above-mentioned harmful effects (loss of efficiency, pressure pulsations).

A further inventive insight lies in that, instead of the plastic, metals are altogether well suited for the sealing elements. Steel has proved itself very well, for example ordinary carbon steel, but also wear-proof special steels.

BRIEF DESCRIPTION OF THE DRAWINGS

The invention is explained in detail in the following with the aid of the drawing. In the drawing.

DETAILED DESCRIPTION OF THE INVENTION

Figure 1:
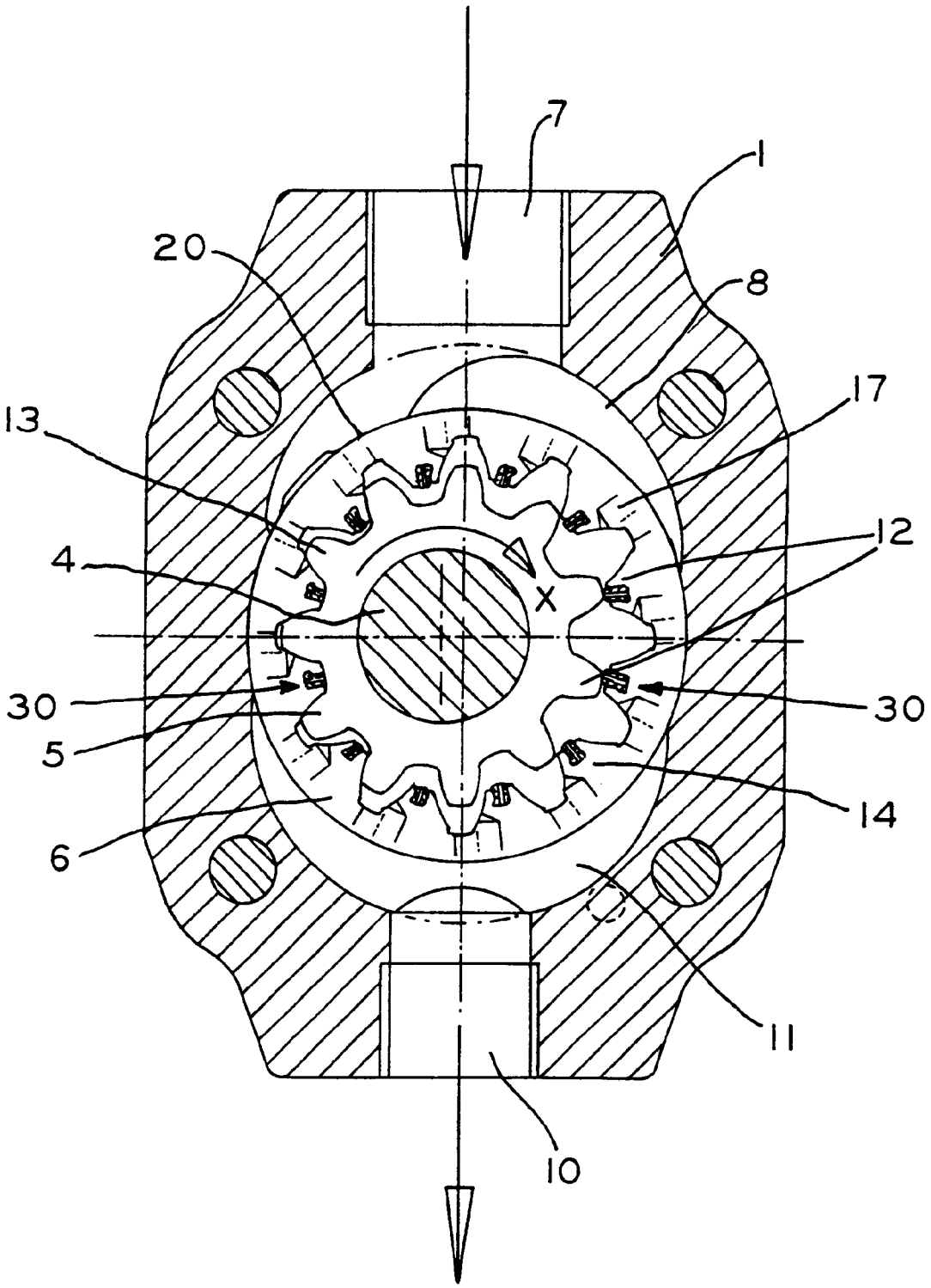
FIG. 1 shows a cross section through a sickleless internal gear pump in the region of the two gear wheels.

FIG. 1 shows in a cross section a sickleless, internal gear wheel pump according to the present invention with one flank, and, namely, in the zone of a housing part 1, to which—as viewed in axial direction—further housing parts are connected. An externally geared pinion 5 stands in engagement with an internally geared hollow wheel and in this manner forms a gearing 12. Pinion 5 is engaged with, and driven by, drive shaft 4 in rotational direction X. The pinion 5 and the hollow wheel 6 are borne not coaxially to one another but eccentrically; further, the pinion 5 has one tooth less than the hollow wheel 6, so that in each case the outside of one tooth tip 13 on the pinion 5 comes in contact with the inside of a tooth tip 14 on the hollow wheel 6. There is to be perceived, further, a suction connection 7 in the zone in which during rotation in arrow direction X the teeth on the pinion 5 and on the hollow wheel 6, respectively pass out of engagement. To the suction connection 7 in the housing part 1 in which the hollow wheel 6 and the pinion 5 are borne, there follows in axial direction, in each case to the adjoining housing parts, a suction pocket 8, which extends over a part of the mantle surface 20 of the hollow wheel 6. A pressure connection 10 is present—likewise proceeding from a pressure pocket 11 extending over a peripheral zone on the hollow wheel 6—on the opposite side of the pump. The inflow from the pressure medium to the interior of the pump, therefore to the tooth gaps in the pinion 5 and in the hollow wheel 6, which bring about the conveyance of the pressure medium, occurs axially and via radial openings 17 in the hollow wheel 6. These openings 17 proceed from the mantle surface 20 of the hollow wheel 6 and issue into its tooth base.

Referring to FIG. 1, on the tooth tips of the hollow wheel there are installed in each case sealing elements 30, which—as viewed in turning direction of the pinion 5—seal off the gearing 12 between pinion 5 and hollow wheel 6.

Figure 2:
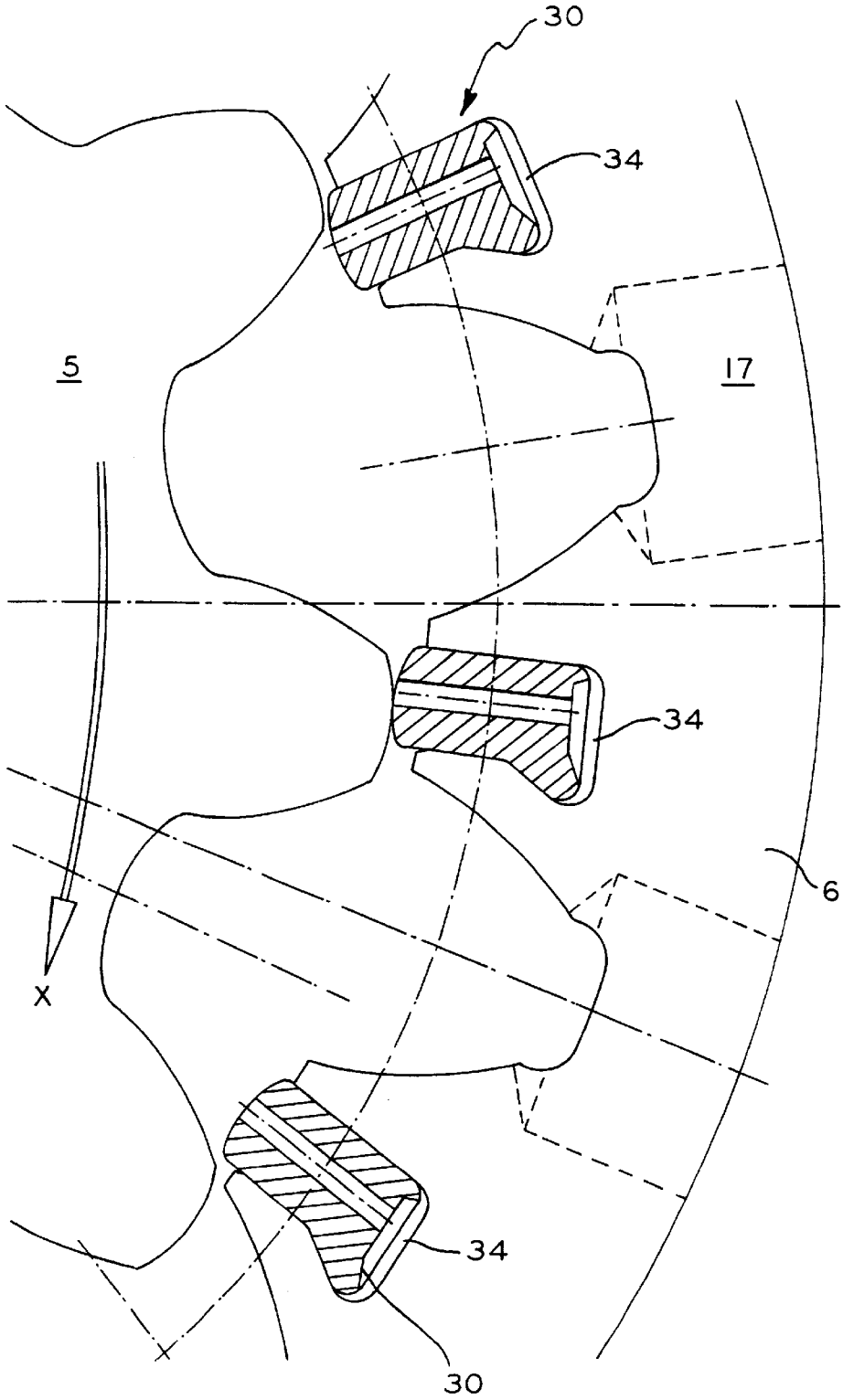
FIG. 2 an enlarged cut-out representation of the zone of the two gear wheels, in which the sealing elements unfold their sealing effect.

According to the cut-out representation in FIG. 2, there is shown how the sealing elements 30 are positively fitted in swallowtail-like profile grooves 34 and how the side surfaces and contact surfaces between sealing elements 30 and profile grooves 34 can be constructed in order to ensure over the width of the gearing 12 as uniform as possible a pressure distribution, and therewith as stable as possible an operating behavior of the pump.

FIG. 2 shows the pinion 5 and the hollow wheel 6 in the range in which the sealing element 30 inserted in the hollow wheel 6 lies with sealing effect on the pinion 5. For the avoidance of efficiency losses in the higher pressure range as well as of pressure pulsations, according to the invention the sealing element 30 consists of steel.

What is claimed is:

1. A sickleless gear wheel pump, comprising:

an internally geared hollow wheel including a plurality of tooth tips;

a pinion including a plurality of tooth tips and meshing with the hollow wheel;

the hollow wheel and pinion being rotatably disposed in a housing;

the housing having a suction connection and a pressure connection;

the hollow wheel having openings for a medium to be pumped therethrough;

each tooth tip of the plurality of tooth tips of the hollow wheel having a profile groove, in which there is present a sealing element that is radially movable during rotation of the hollow wheel and pinion and which is in sliding seal-off engagement with a respective tooth tip of the plurality of tooth tips of the pinion;

wherein each said sealing element is metallic.

2. The sickleless gear wheel pump according to claim 1, wherein each said sealing element consists essentially of steel.

* * * * *